US008572785B2

(12) United States Patent
Christan

(10) Patent No.: US 8,572,785 B2
(45) Date of Patent: Nov. 5, 2013

(54) MATTRESS FOR AIRCRAFT

(75) Inventor: Rudolf Christan, Hamburg (DE)

(73) Assignee: Lufthansa Technik GmbH, Hamburg (DE)

( * ) Notice: Subject to any disclaimer, the term of this patent is extended or adjusted under 35 U.S.C. 154(b) by 1055 days.

(21) Appl. No.: 11/366,809

(22) Filed: Mar. 3, 2006

(65) Prior Publication Data

US 2006/0214056 A1 Sep. 28, 2006

(30) Foreign Application Priority Data

Mar. 10, 2005 (EP) ..... 05005278

(51) Int. Cl.
*A47C 20/02* (2006.01)

(52) U.S. Cl.
USPC ..... 5/740; 5/655.9; 5/694

(58) Field of Classification Search
USPC ..... 5/948, 953, 698, 655.9, 740, 694, 692, 5/488
See application file for complete search history.

(56) References Cited

U.S. PATENT DOCUMENTS

| | | | | |
|---|---|---|---|---|
| 3,803,646 | A * | 4/1974 | Newerowski | 5/496 |
| 4,162,393 | A * | 7/1979 | Balboni | 219/217 |
| 4,316,298 | A * | 2/1982 | Russo et al. | 5/722 |
| 4,449,261 | A * | 5/1984 | Magnusson | 5/722 |
| 4,866,799 | A * | 9/1989 | Glackin | 5/698 |
| 5,513,402 | A * | 5/1996 | Schwartz | 5/691 |
| 5,650,448 | A * | 7/1997 | Wallace et al. | 521/82 |
| 5,817,391 | A * | 10/1998 | Rock et al. | 428/86 |
| 5,937,465 | A * | 8/1999 | Carew et al. | 5/732 |
| 5,963,998 | A * | 10/1999 | Carew et al. | 5/655 |
| 6,026,525 | A * | 2/2000 | Davis | 5/99.1 |
| 2004/0098806 | A1 * | 5/2004 | Stender et al. | 5/654 |
| 2004/0132364 | A1 * | 7/2004 | Wulliman et al. | 442/38 |
| 2005/0172406 | A1 * | 8/2005 | Post | 5/626 |

FOREIGN PATENT DOCUMENTS

| | | |
|---|---|---|
| DE | 10026405 | 12/2000 |
| DE | 10013492 | 9/2001 |
| DE | 102 40 462 | 6/2003 |
| DE | 10240462 | 6/2003 |
| EP | 0 070 701 | 1/1983 |
| EP | 0 231 968 | 8/1987 |

OTHER PUBLICATIONS

Flammability: Achieving Compliance taken from BEDtimes/Sep. 2002 available at http://www.safesleep.org/pdf/september2002.pdf.*

European Search Report mailed Aug. 12, 2005, directed to EP Application No. 05 00 5278.6.

(Continued)

*Primary Examiner* — William Kelleher
(74) *Attorney, Agent, or Firm* — Morrison & Foerster LLP

(57) ABSTRACT

A mattress for use in aircraft includes a lying surface and a low-flammability foam core. The foam core has, on the side facing the lying surface, a large-area recess which occupies at least 70% of the lying surface. The recess is surrounded in the edge regions of the lying surface by a foam web and a lying base that includes a spacer textile that is inserted into the recess. The fibers of the spacer textile have low flammability. This mattress offers a high degree of comfort and at the same time fulfills requirements under aviation law as regards low flammability.

15 Claims, 1 Drawing Sheet

(56) References Cited

OTHER PUBLICATIONS

C.F.R. Title 14: Aeronautics and Space Part 25—Airworthiness Standards: Transport Category Airplanes Subpart D—Design and Construction §25.853 Compartment Interiors, current as of Jan. 4, 2007, located at <http://ecfr.gpoaccess.gov/cgi/t/text/text-idx?c=ecfr&sid=6b2cf7ea6990aa8779e35f260b27c358&rgn=div8&view=text&node=14:1.0.1.3.11.4.181.74&idno=14> visited on Jan. 8, 2007 (2 pages).

C.F.R. Title 14:Aeronautics and Space Part 25—Airworthiness Standards: Transport Category Airplanes Subpart G—Operating Limitations and Information Appendix F to Part 25 Part II—Flammability of Seat Cushions, current as of Jan. 4, 2007, located at <http://ecfr.qpoaccess.gov/cgi/t/text/text-idx?c=ecfr&sid=6b2cf7ea6990aa8779e35f260b27c358&rgn=div9&view=text&node=14:1.0.1.3.11.7.201.35.20&idno=14> visited on Jan. 8, 207 (6 pages).

* cited by examiner

Fig.1
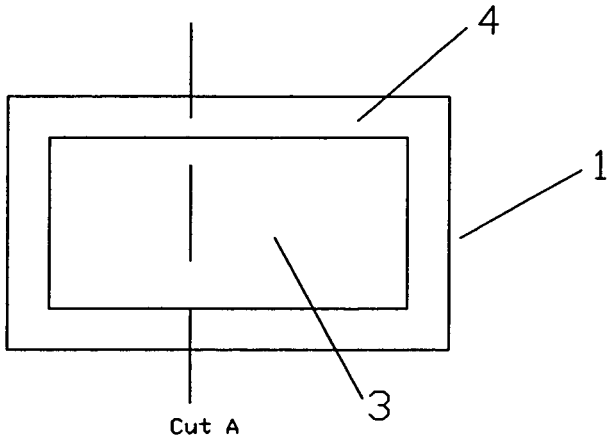
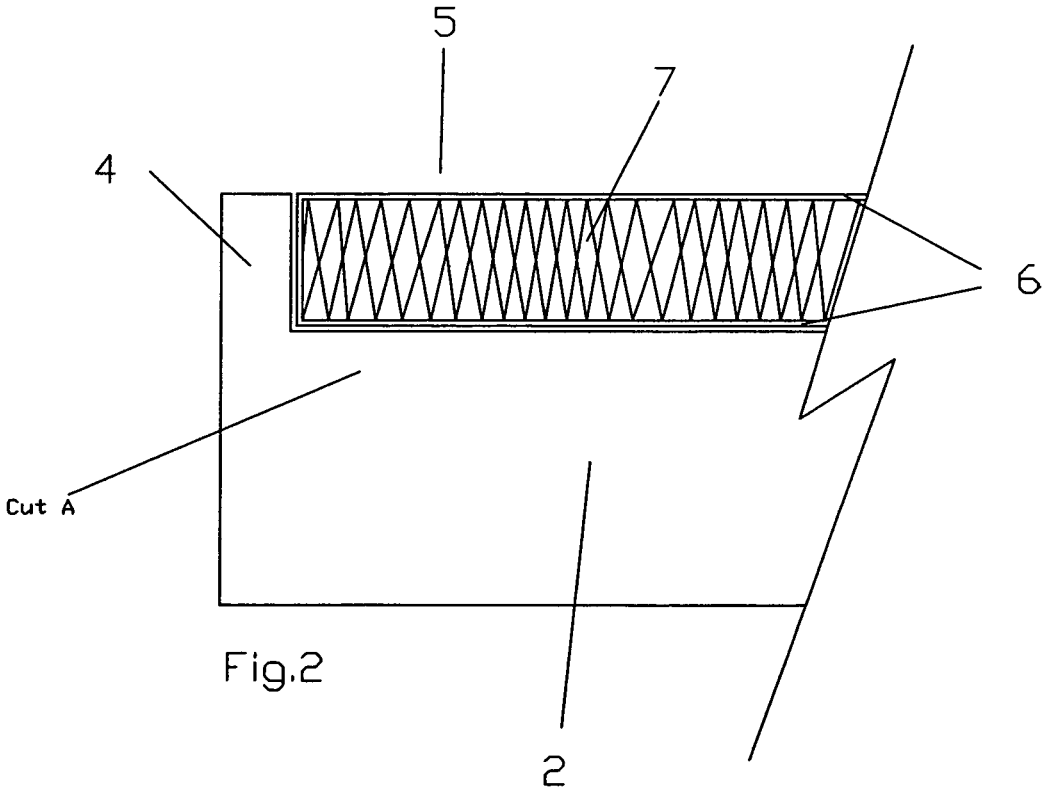
Fig.2

MATTRESS FOR AIRCRAFT

FIELD AND BACKGROUND OF THE INVENTION

The invention relates to a mattress for aircraft. On board VIP aircraft, business jets and government aircraft, and occasionally in First Class in commercial transport aircraft, beds having a level lying surface are used. The mattress used for such beds requires a licence under aviation law and, in particular, has to be tested for flammability by a method described in more detail below. Mattresses fulfilling requirements under aviation law usually offer a low degree of lying comfort.

SUMMARY OF THE INVENTION

The object on which the invention is based is, therefore, to provide a mattress which is suitable for aircraft and has a higher degree of lying comfort.

The mattress according to the invention for aircraft has a lying surface and a low-flammability foam core. It is characterized by the following features:

a) the foam core has, on the side facing the lying surface, a large-area recess which occupies at least 70%, preferably at least 80%, further preferably at least 90%, of the lying surface, b) the recess is surrounded in the edge regions of the lying surface by a foam web, c) a lying base consisting of a spacer textile is inserted into the recess, d) the fibres of the spacer textile have low flammability.

Some terms used within the scope of the invention will be explained first.

The foam core of the mattress according to the invention has low flammability. This requirement is fulfilled whenever the finished mattress, overall, satisfies the requirements under aviation law (see below for more details of this). The lying surface of the mattress according to the invention has a size which enables average persons to sleep comfortably. As a rule, it is at least 1.80 m, preferably at least 1.90 m, further preferably at least 2.00 m long and, in the case of a single bed, is at least 60 cm, preferably at least 80 cm, further preferably at least 1 m wide. The lying surface may extend over the large-area recess, still to be described in more detail, of the foam core and over the edge region of the foam core together with its foam webs. Other dimensions of the lying surface which are adapted to the local conditions are possible.

According to the invention, there is provision for the foam core to have, on the side facing the lying surface, a large-area recess which occupies the surface portions, as defined herein, of the corresponding mattress side. The recess is preferably a flat depression which is preferably adapted to the mattress shape, that is to say, in particular, is rectangular, and which is surrounded in the edge regions of the mattress by a foam web projecting horizontally (perpendicularly to the lying surface) beyond the recess. In other words, the foam core possesses a smaller thickness in the region of the recess than in the edge regions of the core having the webs arranged there.

A lying base consisting of a spacer textile is inserted into the recess of the foam core. The fibres of this spacer textile have low flammability.

Spacer textiles have two textile base surfaces (in particular, woven or knitted surfaces) which run essentially parallel to and at a distance from one another and between which extend spacer threads which connect the base surfaces and which are tied into the base surfaces according to the textile surface-forming method used. The spacer threads may have intersecting directions of extent which run diagonally in the longitudinal section or cross section of the cloth; furthermore, they may, as desired, have intersecting spacer threads running diagonally to the direction of production of the textile or else run between the base surfaces approximately perpendicularly to these base surfaces. Such spacer textiles may absorb load, be permanently elastic and be provided with lasting spring-back properties. On account of the spacer layer running between the two base surfaces, they have very good thermo-physiological properties and, in particular, can absorb and dissipate the heat and moisture emitted by the body.

Spacer textiles suitable for the mattress according to the invention are known from the prior art and are described, for example, in DE 100 26 405 A1, DE 100 13 492 A1 and DE 102 40 462 A1. In these textiles the spacer threads that connect the base surfaces are arranged in groups. Each group includes two intersecting spacer threads arranged at an angle to the base surfaces and spans a plane that is vertical relative to the base surface. The different groups have different orientations relative to the production directions of the bas surfaces. That is, some of the groups are arranged parallel to the production direction of the base fabric, some of the groups are arranged perpendicularly to the production direction and some of the groups are arranged diagonally to the production direction. These textiles also include spacer threads that are orthogonal to the base surfaces.

In the prior art, only foam mattresses consisting of low-flammability foam are ever used in aircraft. The reason for this is that, for the licence under aviation law, the mattresses must pass an oil-burner test and a Bunsen-burner test, as they are known (FAR/EASA paragraph 25.853 Flammability of Seat Cushions). Foam blocks having a flame-proof finish are closed-cell foam and do not allow any circulation of moisture. The lying properties are therefore unfavourable.

In the oil-burner test mentioned, a seat cushion or the mattress is exposed from the side (that is to say, parallel to the lying surface) to a kerosene flame and in this case should be burnt or destroyed only within specific limits described in more detail in the standard mentioned. In the prior art, this oil-burner test has only ever been passed by correspondingly finished foam mattresses.

The spacer textiles used according to the invention are actually completely unsuitable for passing the oil-burner test. The reason for this is that, between the two textile layers, they have a spacer layer which is filled only relatively loosely with spacer threads and which, under the action of a flame from the side, acts in the same way as a chimney flue and distributes the flame and hot combustion gases quickly over a large area. It was shown, then, surprisingly, that the use of a comfort-enhancing spacer textile in an aviation mattress is nevertheless possible if this textile is surrounded laterally by the foam webs defined in more detail in the patent claim. The foam web ensures that, in the oil-burner test (flame action from the side), the flame does not act directly on the spacer textile and, in particular, cannot flash from the side into the clearance between the two woven surfaces or knitted surfaces. Instead, the foam web blocks the flame for a sufficiently long time to prevent the combustion gases and combustion effects from being propagated over a large area through the clearance of the spacer textile.

The foam web surrounds the edge regions of the lying surface. According to the invention, it may, in particular, have a horizontal width (parallel to the lying surface) of 2 to 9 cm. This thickness is sufficient, during the oil-burner test, largely to prevent the flame from flashing laterally into the spacer textile. The depth of the recess and the thickness of the base are preferably 2 to 6 cm, further preferably about 3 cm. The thickness of the lying base preferably corresponds approximately to the depth of the recess.

The spacer textile is preferably a woven spacer fabric or particularly preferably a knitted spacer fabric. In the case of a woven spacer fabric, the textile base surfaces are woven, and, in the case of a knitted fabric, they are correspondingly knitted. Between these textile base surfaces or base layers, the thread groups already described above extend, which are integrally woven or knitted together with the two base surfaces. These are preferably flame-proof threads which contain flame-proof materials, such as, for example, KEVLAR® (du Pont trademark for aramid fiber). Producing the lying base from threads which are flame-proof from the outset (instead of a flame-proof finish) has the advantage that the breathability of the lying base is preserved and therefore lying comfort is increased.

If "flame-proof" or "low flammability" is referred to in this connection, this always means a quality or finish which allows the mattress according to the invention, overall, to pass the oil-burner test mentioned.

The lying base is preferably inserted into the recess of the foam core and can therefore be cleaned or changed, as required. It may have an anti-allergenic action, since allergens, as it were, fall through the loose thread groups of the spacer layer between the two textile base surfaces.

BRIEF DESCRIPTION OF THE DRAWINGS

An exemplary embodiment of the invention is explained below by means of the drawing in which:

FIG. 1 shows a view of a mattress according to the invention from above;

FIG. 2 shows diagrammatically a cross section taken along line 2-2 in FIG. 1 through an edge region of the mattress.

DETAILED DESCRIPTION OF THE INVENTION

The mattress according to the invention is designated as a whole by 1. It has a foam core 2 which has a large-area recess 3 on the side facing the lying surface. The recess 3 is surrounded in the edge region of the mattress by foam webs 4. The foam webs 4 are connected in one piece to the foam core 2.

A lying base, designated as a whole by 5, consisting of a spacer textile is inserted into the recess 3. The lying base has two textile base surfaces 6, between which spacer threads 7 extend as loose thread groups and thus form an elastic restorable cushion.

The mattress according to the invention may have further coverings (for example, of wool or of another material), not illustrated in the drawing, and be provided with a mattress sheet.

The invention claimed is:

1. A mattress for use in an aircraft, having a lying surface and a low-flammability foam core, wherein:

(a) the foam core has, on a side adjacent the lying surface, a large-area recess formed therein which covers at least 70% of the lying surface;

(b) the recess is surrounded in edge regions of the lying surface by a foam web, (c) a lying base comprising a spacer textile is inserted into the recess, the spacer textile comprising two textile base surfaces that run parallel at a distance from each other and spacer threads that connect to the two textile base surfaces, (d) fibers of the spacer textile have low flammability, and (e) the depth of the recess and the thickness of the lying base are approximately the same.

2. The mattress of claim 1, wherein the foam web has a horizontal width of 2 to 9 cm.

3. The mattress of claim 1 or 2, wherein the depth of the recess and the thickness of the lying base are 2 to 6 cm.

4. The mattress of claim 1 or 2, wherein the spacer textile is a knitted spacer fabric.

5. The mattress of claim 1 or 2, wherein the spacer textile is exchangeable.

6. The mattress of claim 1 or 2, wherein the low-flammability fiber comprises an aramid.

7. The mattress of claim 1 or 2, wherein the spacer textile is breathable.

8. The mattress of claim 1 or 2, wherein the spacer textile is anti-allergenic.

9. The mattress of claim 2, wherein the large-area recess covers at least 80% of the lying surface.

10. The mattress of claim 3, wherein the large-area recess covers at least 80% of the lying surface.

11. The mattress of claim 4, wherein the large-area recess covers at least 80% of the lying surface.

12. The mattress of claim 2, wherein the large-area recess covers at least 90% of the lying surface.

13. The mattress of claim 3, wherein the large-area recess covers at least 90% of the lying surface.

14. The mattress of claim 4, wherein the large-area recess covers at least 90% of the lying surface.

15. The mattress of claim 1 or 2, wherein the depth of the recess and the thickness of the lying base are about 3 cm.

* * * * *

UNITED STATES PATENT AND TRADEMARK OFFICE

CERTIFICATE OF CORRECTION

PATENT NO. : 8,572,785 B2
APPLICATION NO. : 11/366809
DATED : November 5, 2013
INVENTOR(S) : Rudolf Christan It is certified that error appears in the above-identified patent and that said Letters Patent is hereby corrected as shown below:

On the Title page, Item (73) Assignee:

Please delete "Lufthansa Technik GmbH" and add --Lufthansa Technik AG--

Signed and Sealed this
Fourth Day of March, 2014

Michelle K. Lee

Michelle K. Lee
*Deputy Director of the United States Patent and Trademark Office*